United States Patent [19]

Taniguchi

[11] Patent Number: 5,034,659

[45] Date of Patent: Jul. 23, 1991

[54] LAMP CIRCUIT WITH DISCONNECTED LAMP DETECTING DEVICE

[75] Inventor: Shozo Taniguchi, Hinode, Japan

[73] Assignee: Kabushiki Kaisha Toshiba, Kawasaki, Japan

[21] Appl. No.: 559,138

[22] Filed: Jul. 30, 1990

[30] Foreign Application Priority Data

Jul. 31, 1989 [JP] Japan ..... 1-198409

[51] Int. Cl.[5] ..... H05B 37/00

[52] U.S. Cl. ..... 315/131; 315/130; 340/642

[58] Field of Search ..... 315/130, 131, 256, 189, 315/185 R, 185 S; 340/642

[56] References Cited

U.S. PATENT DOCUMENTS

| | | | |
|---|---|---|---|
| 3,829,735 | 8/1974 | Berlock et al. | 315/131 |
| 4,295,079 | 10/1981 | Otsuka et al. | 315/130 |
| 4,396,868 | 8/1983 | Watanabe et al. | 315/130 |
| 4,441,055 | 4/1984 | Balchjunas et al. | 315/256 |
| 4,675,574 | 6/1987 | Delflache | 315/130 |

FOREIGN PATENT DOCUMENTS

| | | | |
|---|---|---|---|
| 1506451 | 4/1978 | United Kingdom | 315/130 |

OTHER PUBLICATIONS

New Constant-Current Regulator for Airport Lighting, by Helmut et al., System and Equipment, 1969, pp. 355–358.

*Primary Examiner*—Eugene R. LaRoche
*Assistant Examiner*—Tan Xuan Dinh
*Attorney, Agent, or Firm*—Foley & Lardner

[57] ABSTRACT

In a series lamp circuit designed to connect lamps to the secondary windings of current transformers connected in series with a constant-current power supply, the series lamp circuit provides a disconnected lamp detecting means and a short-circuit switch for each lamp. The short-circuit switch serves to short-circuit the secondary windings of the transformers in response to the output of the detecting means. By actuating the short-circuit switch, the short-circuit switch is switched off during a short-circuit releasing time defined uniquely for a lamp at each predetermined inspection period. The power device side serves to detect the quantity of disconnected lamps on the basis of the output voltage and current and detect an OFF operating time of the short-circuit switch on the basis of an output voltage waveform of the power supply. Hence, it is possible to identify which lamp is disconnected and display the identified result on a display. An alarm is issued when the disconnected lamp is detected.

6 Claims, 4 Drawing Sheets

LAMP CIRCUIT WITH DISCONNECTED LAMP DETECTING DEVICE

BACKGROUND OF THE INVENTION

1. Field of the Invention

The present invention generally relates to a lamp circuit providing a plurality of lamps connected in series, and more particularly, to a lamp circuit providing a means for identifying which lamp is disconnected.

2. Description of the Prior Art

For runway lighting in an airport, series lamp circuits are generally employed. The series lamp circuit includes current transformers, each of which provides a secondary winding connected with a corresponding lamp and a primary winding connected in series with each other, and a constant-current regulating circuit for supplying constant current through the secondary coils connected in series so that the constant current is supplied through each lamp, thereby allowing each lamp to be lighted at constant brightness.

The lamp circuit designed as above has already had a proposed invention about a disconnected lamp detecting device for detecting the occurrence of disconnection as well as the quantity of disconnected lamps (see U.S. Pat. Nos. 4,295,079 and 4,396,868). Those conventional disconnected lamp detecting devices, however, are incapable of identifying which lamp is disconnected. Hence, once the device detects the occurrence of disconnection, it is necessary for maintenance operators to check which lamp is disconnected by moving around a runway in an airport. This is quite inefficient.

Furthermore, if the replacement of the disconnected lamp is retarded, the secondary winding of the transformer connected to the disconnected lamp is left open for a long period of time. In this condition, there is a danger of a winding short upon the application of a light voltage and of a burn-out due to rising temperature.

SUMMARY OF THE INVENTION

It is therefore an object of the present invention to provide a lamp circuit with a disconnected lamp detecting device which is capable of detecting not only the occurrence of disconnection and the quantity of disconnected lamps but also the location of the disconnected lamp.

To achieve the foregoing object, the lamp circuit with a disconnected lamp detecting device comprises;

a constant-current power supply, a plurality of current transformers, each of the plurality of current transformers having a primary winding and a secondary winding, respectively, the primary windings of the plurality of current transformers being connected in series with the constant-current power supply, a plurality of lamps, each one of the plurality of lamps being connected to the secondary winding of one of the plurality of current transformers, respectively, a plurality of terminal units, each one of the plurality of terminal units being connected to the secondary winding of one of the plurality of current transformers, respectively, each of the plurality of terminal units comprising, a short-circuit switch being connected to the secondary windings, the switch being normally off, a disconnection detector for detecting the disconnection of the lamp, a short-circuit control means for causing the short-circuit switch to be switched on in response to the output sent from the disconnecting detector, and a short-circuit releasing time setting means for releasing the ON state of the short-circuit switch during each short-circuit releasing time at every predetermined check period, the releasing time having different values for the plurality of lamps, a disconnection quantity deriving means for detecting the occurrence of a disconnected lamp and computing the quantity of disconnected lamps on the basis of an integral value of an output voltage given within a predetermined period, the integral value being defined on the waveform changes of an output current and an output voltage of the constant-current power supply, and a disconnected lamp location identification means for continuously measuring an integral value computed by the disconnection quantity deriving means and identifying which location is disconnected from a time when the current integral value is made larger than the previous value.

DETAILED DESCRIPTION OF THE PREFERRED EMBODIMENTS

Figure 1:
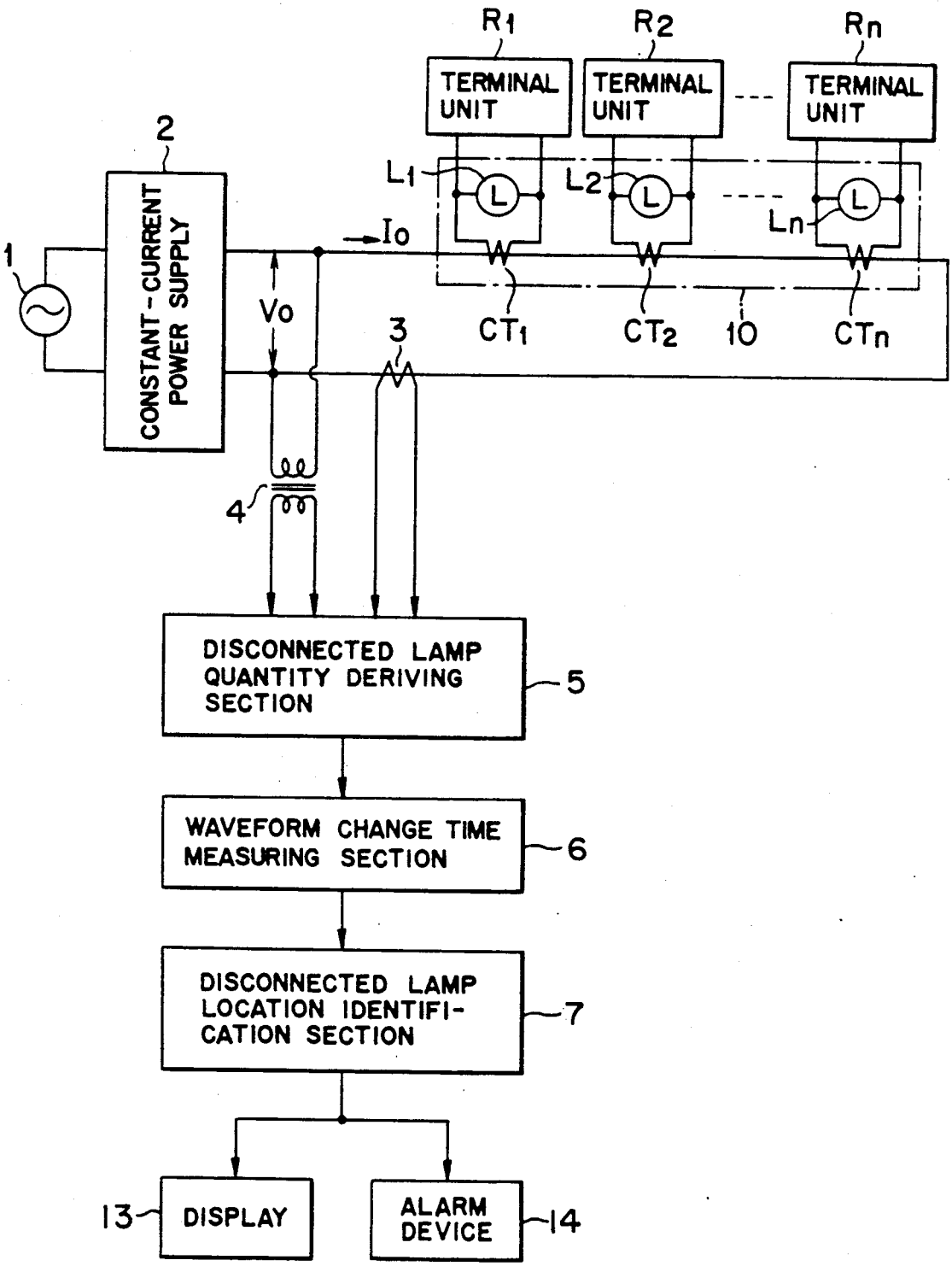
FIG. 1 is a block diagram showing a disconnected lamp detecting device according to a first embodiment of the invention.

FIG. 1 shows a disconnected lamp detecting device provided in a series lamp circuit according to a first embodiment of the invention.

The circuit device includes an a.c. power source 1, a constant-current power supply 2, and a serial lamp circuit 10 so that the a.c. power source 1 supplies power to the serial lamp circuit 10 through the constant-current power supply 2. The constant-current power supply 2 serves to phase-control the power sent from the power source 1 and supply constant current. The serial lamp circuit 10 consists of a plurality (1 to n) of current transformers $CT_1, CT_2, \ldots, CT_n$ whose primary windings are series-connected with one another and a plurality of lamps $L_1, L_2, \ldots, L_n$ which are connected to the secondary windings of the transformers in one-to-one relation. Constant current is supplied to the lamps $L_1$ to $L_n$ from the constant-current power supply 2 powered by the a.c. power source 1 through the transformers $CT_1$ to $CT_n$ so that each lamp can maintain a constant brightness. The constant-current power supply employs, for example, a thyristor operating to control a firing angle, for example.

The lamps $L_1, L_2, \ldots, L_n$ provide terminal units $R_1, R_2, \ldots, R_n$ in one-to-one relation. Each terminal unit has the same internal arrangement, which will be described later with reference to FIG. 2.

Figure 2:
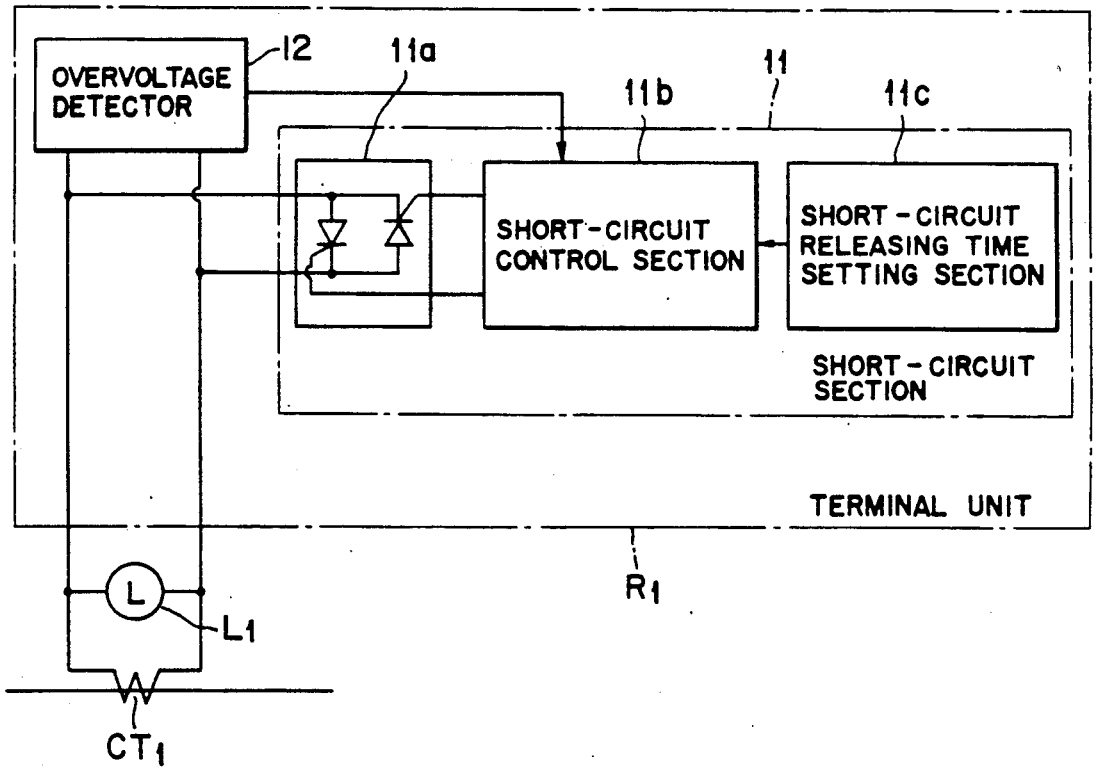
FIG. 2 is a block diagram showing a terminal unit contained in the disconnected lamp detecting device.

FIG. 2 shows internal arrangement of the terminal unit $R_1$. As shown, the terminal unit $R_1$ is connected to the secondary winding of the transformer $CT_1$ and an overvoltage detector 12 and a short-circuit section 11 are connected in parallel to the lamp $L_1$. The overvoltage detector 12 is provided as a disconnected lamp detecting means so that it can detect the disconnected lamp in light of a high voltage generated on the secondary winding of the transformer $CT_1$. The high voltage results from the disconnected lamp $L_1$. This overvoltage detector 12 has such high impedance that no overcurrent is allowed to flow into the detector 12. The short-circuit section 11 comprises a short-circuit switch 11*a* for short-circuiting the secondary winding of the transformer $CT_1$ when the lamp is disconnected, a short-circuit releasing time setting section 11*c* for setting a time when the short-circuit is released, and a short-circuit control section 11*b* for controlling the short-circuit switch on and off on the basis of the short-circuit releasing time set by the short-circuit releasing time setting section 11*c* and an output signal supplied by the overvoltage detector 12. The short-circuit switch 11*a* consists of a pair of thyristors in an antiparallel connection.

Next, the operation of the terminal unit $R_1$ designed above will be described. When the lamp $L_1$ is disconnected, a high voltage occurs on the secondary winding of the transformer $CT_1$. Then, when the overvoltage detector 12 detects the high voltage, it sends out a detection signal to the short-circuit control section 11*b*. In response to the detection signal indicating the high voltage occurs on the secondary side of the transformer $CT_1$, the short-circuit control section 11*b* serves to switch on the short-circuit switch 11*a* for short-circuiting the secondary winding of the transformer $CT_1$. This short-circuit is released on the short-circuit releasing time set by the short-circuit releasing time setting section 11*c*. The interval of the short-circuit releasing time has respective values $t_1, t_2, \ldots, t_n$ set uniquely for the short-circuit releasing time setting sections included in the terminal units $R_1, R_2, \ldots, R_n$ as shown in FIG. 1. As such, the short-circuit caused on the secondary winding of the transformer $CT_1$ is released during the time $t_1$ set uniquely for the terminal unit $R_1$ at each predetermined inspection period T (see FIG. 3).

The constant-current power supply 2, on the other hand, provides on its output side a current detector 3, a voltage detector 4, a disconnected lamp quantity deriving section 5, a waveform change time measuring section 6, a disconnected lamp location identification section 7, a display 13, and an alarm unit 14.

The disconnected lamp quantity deriving section 5 receives an output voltage $V_0$ and an output current $I_0$ from the constant-current power supply 2 through the voltage detector 4 and the current detector 3 provided on the output side of the constant-current power supply 2. It serves to detect the quantity of disconnected lamps from the lamps $L_1$ to $L_n$ based on the output (see U.S. Pat. No. 4,295,079).

Figure 4:
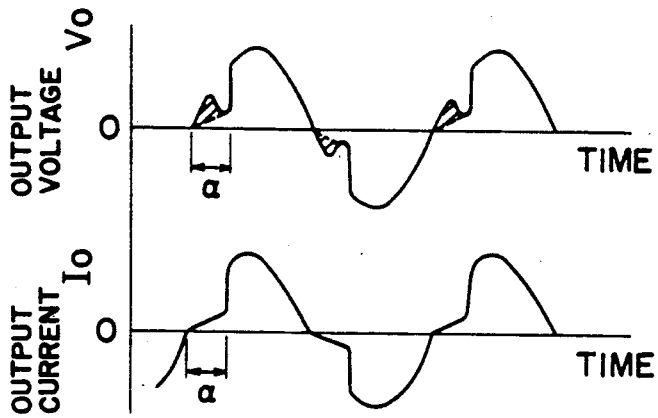
FIG. 4 is a chart showing the changes of waveforms of output voltage and current given by the constant-current power supply when disconnection occurs.

When one or more of the lamps $L_1$ to $L_n$ are disconnected, the secondary windings of the transformers connected to the disconnected lamps are left open so that the series lamp circuit 10 changes the load impedance as viewed from the constant-current power supply 2. The disconnected lamp quantity deriving section 5 serves to detect the disconnected lamps in light of the impedance change. When any one of the lamps provided in the series lamp circuit 10 is disconnected, the output voltage $V_0$ and the output current $I_0$ of the constant current regulating section 2 are changed as shown in FIG. 4. That is, if the lamp is disconnected, until the transformer reaches magnetic saturation, the constant current regulating section 2 supplies relatively a small current $I_0$ having a delayed leading edge. On the other hand, the output voltage $V_0$ has a waveform designed so that it abruptly rises while the leading edge of the output current $I_0$ is retarded. There is represented the linear correlation between the quantity of disconnected lamps and a voltage waveform portion, as shown by the hatching, accompanying with magnetic saturation, that is, a voltage integral value matching to an integral value (area shown by hatching) of the output voltage $V_0$ in the interval (saturation time) $\alpha$ from a trailing edge immediately before the output voltage $I_0$ in the period just previous to an abrupt leading edge caused by the saturation. It indicates that the quantity of disconnected lamps can be derived by measuring the integral value of the output voltage $V_0$ given within the interval $\alpha$.

Figure 3:
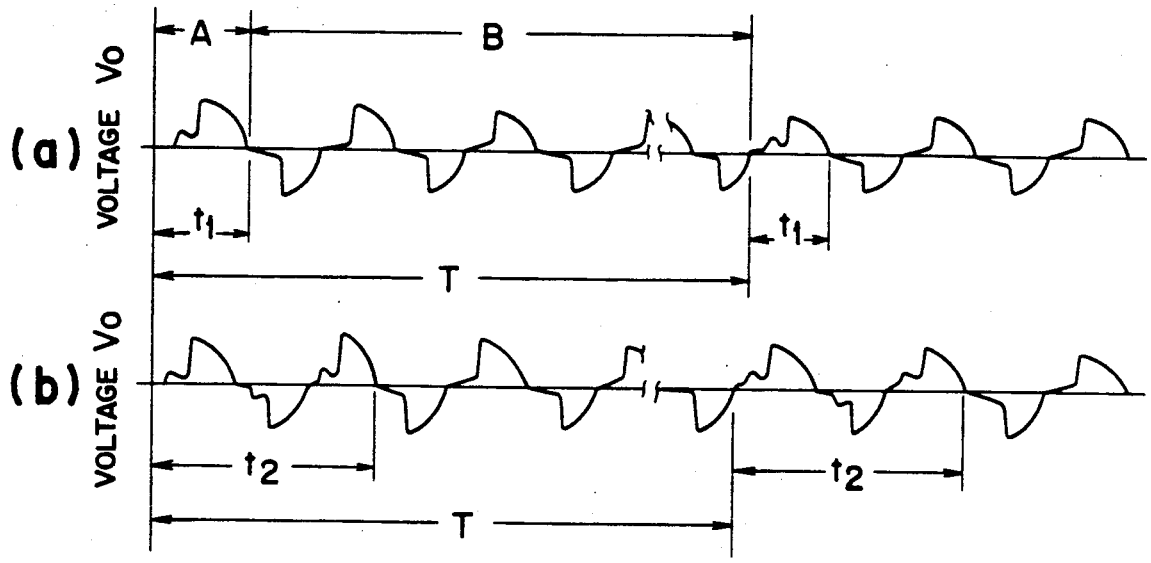
FIGS. 3(*a*) and (*b*) are charts showing the changes of waveforms of output voltages given by a constant-current power supply included in the detecting device.

As described above, in case of short-circuiting the secondary winding of the transformer $CT_1$ or releasing the short-circuit, the output voltage $V_0$ of the constant-current power supply 2 is changed as shown in FIG. 3(*a*). That is, during an interval $t_1$ indicated by a reference note A within a period T, the secondary winding of the transformer $CT_1$ is released. It means that the lamp $L_1$ is disconnected and is left disconnected. During the interval $t_1$, therefore, the output voltage $V_0$ of the constant-current power supply 2 abruptly rises, thereby increasing the voltage-time integral value. During an interval indicated by a reference note B, the secondary winding of the transformer $CT_1$ is short-circuited. It is equivalent to the case that the lamp $L_1$ is not disconnected as viewed from the constant-current power supply 2. In this case, the output voltage waveform of the constant-current power supply 2 is analogous to that in a normal mode as shown in FIG. 3(*a*), resulting in a drop of the voltage-time integral value to lower than that during the interval A. The interval A (at which the constant-current power supply 2 starts to change the output voltage waveform) is measured by the waveform change time measuring section 6 on the basis of the output voltage $V_0$ of the constant-current power supply 2, which is detected by the voltage detector 4. This measurement is performed using a voltage integral value within the interval A derived by the disconnected lamp number deriving section 5. If the integral value becomes higher than the integral value measured just before the current period by a reference value, it corresponds to the interval indicated by the note A. When the integral value is made lower by the reference value or more, it is determined that the interval A is shifted to the interval B (short-circuiting state).

Next, based on the short-circuit releasing time for the interval A being derived by the foregoing process, the disconnected lamp location identification section 7 serves to determine which lamp is disconnected.

At first, the occurrence of disconnection on any one of the lamps is detected on the change of a voltage integral value. Furthermore, if the time when the integral is being changed is equal to the short-circuit releasing time $t_1$ set by the short-circuit releasing time setting section 11*c* as shown in FIG. 3(*a*), it is determined that the lamp $L_1$ is disconnected.

And, though only one lamp is disconnected similarly as described above, if the time is equal to the short-circuit releasing time $t_2$ as shown in FIG. 3(*b*), it is determined that the lamp $L_2$ is disconnected.

As will be understood from the above description, by checking whether a difference value (increment) between the voltage integral value at the current period and that at the period just before the current period is higher than a reference value, it is determined that the secondary winding of the transformer is short-circuited or the short-circuit is released on a terminal unit $R_i$ (i = 1, 2, . . . , n) when a lamp is disconnected. Even if a certain terminal unit $R_i$ enters into a short-circuit releasing state, it is possible to easily identify the terminal unit on the basis of the difference (increment).

The disconnected lamp location determining section 7 displays the result on a display 13, and an alarm device 14 is provided for warning of the occurrence of disconnection.

As described above, this lamp circuit is capable of precisely determining which lamp is disconnected. For finding the disconnected lamp, it is not necessary for the maintenance operators to check all the lamps by moving around a runway in an airport. It results in greatly improving the efficiency of maintenance operation for the lamps provided on the runway. Moreover, if the lamp is disconnected, by short-circuiting the secondary winding of the current transformer and releasing the short-circuit for a relatively short time at each constant period T, it is possible to avoid generating a high voltage on the secondary winding of the transformer for a long time. It results in enabling the prevention of short-circuits or burn-outs of the transformer windings and notifying the locations of one or more disconnected lamps on the display.

Figure 5:
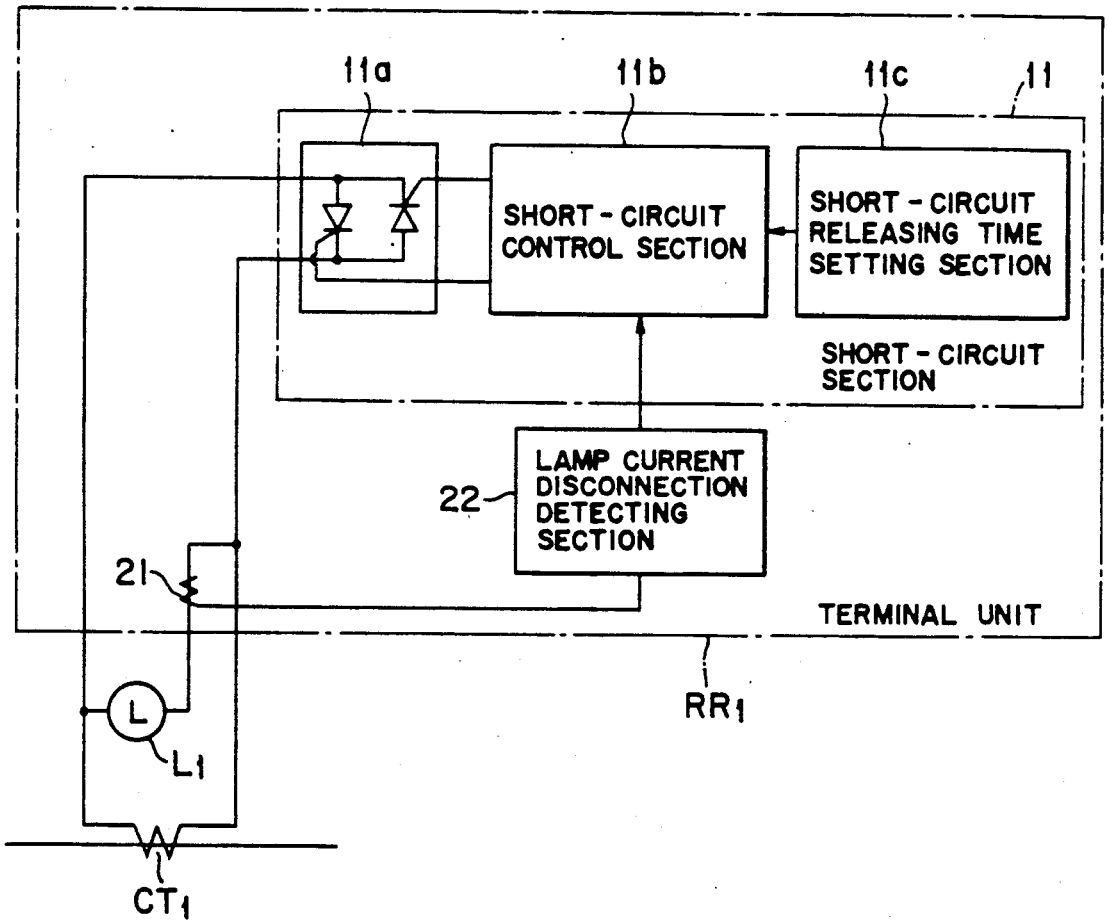
FIG. 5 is a block diagram showing a terminal unit according to a second embodiment of the invention.

Next, a second embodiment of the invention will be described. This embodiment is identical to the first embodiment except that it has other arrangement of the terminal units $R_1, R_2, \ldots, R_n$ than the first embodiment. This terminal unit $RR_1$, as shown in FIG. 5, provides a lamp current disconnection detecting section 22, which serves to detect the disconnection of current flown through the lamp $L_1$ on the basis of the output of an auxiliary current transformer 21 connected in series with the lamp $L_1$ and then send the detection signal to a short-circuit control section 11*b*.

The foregoing embodiments are described as examples and do not define the lamp disconnection detecting device according to the invention. As another embodiment, for example, the switch 11*a* shown in FIGS. 2 and 5 may employ a semiconductor switching element without using the thyristor.

What is claimed is:

1. A lamp circuit with a disconnected lamp detecting device comprising:

a constant-current power supply, a plurality of current transformers, each of said plurality of current transformers having a primary winding and a secondary winding, respectively, said primary windings of said plurality of current transformers being connected in series with said constant-current power supply, a plurality of lamps, each one of said plurality of lamps being connected to said secondary winding of one of said plurality of current transformers, respectively, a plurality of terminal units, each one of said plurality of terminal units being connected to said secondary winding of one of said plurality of current transformers, respectively, each of said plurality of terminal units comprising, a short-circuit switch being connected to the secondary windings, said switch being normally off, a disconnection detecting means for detecting the disconnection of the lamp, a short-circuit control means for causing the short-circuit switch to be switched on in response to the output sent from the disconnecting detecting means, and a short-circuit releasing time setting means for releasing the ON state of the short-circuit switch during each short-circuit releasing time at every predetermined check period, said releasing time having different values for the plurality of lamps, a disconnection quantity deriving means for detecting the occurrence of a disconnected lamp and computing the quantity of disconnected lamps on the basis of an integral value of an output voltage given within a predetermined period, said integral value being defined on the waveform changes of an output current and an output voltage of said constant-current power supply, and a disconnected lamp location identification means for continuously measuring an integral value computed by said disconnection quantity deriving means and identifying which location is disconnected from a time when the current integral value is made larger than the previous value.

2. The circuit as claimed in claim 1, wherein said disconnected lamp detecting means serves to detect the disconnection of a lamp from an overvoltage generated on the secondary winding of said transformer, said overvoltage resulting from said disconnection of a lamp.

3. The circuit as claimed in claim 1, wherein said disconnected lamp detecting means serves to detect disconnection of a lamp from disconnection of current flown through the lamp, said disconnection of current resulting from said disconnection of a lamp.

4. The circuit as claimed in claim 1, wherein said short-circuit switch employs a semiconductor switching element such as a thyristor.

5. The circuit as claimed in claim 1, wherein if the disconnection of a lamp occurs, said disconnected lamp operating means serves to integrate said output voltage within the predetermined time, said predetermined time is defined as an interval between a leading edge of output current at the current half cycle and a trailing edge of the output current at the just previous half cycle.

6. The circuit as claimed in claim 1, further comprising:

a display for displaying the result of said disconnected lamp location identification means, and an alarm device for issuing an alarm when said disconnection quantity deriving means serves to detect disconnection of a lamp.

* * * * *